US005332240A

United States Patent [19]

Bedoian

[11] Patent Number: 5,332,240

[45] Date of Patent: Jul. 26, 1994

[54] DRILL CHUCK KEY TOOL

[76] Inventor: Paul Bedoian, 25077 Avocet Cir., Hemet, Calif. 92544

[21] Appl. No.: 61,723

[22] Filed: May 17, 1993

[51] Int. Cl.[5] ..... B25B 13/44

[52] U.S. Cl. ..... 279/147; 81/16; 81/177.85; 279/149

[58] Field of Search ..... 279/143-145, 279/147-149; 81/16, 177.85, 121.1, 124.6, 460, 436

[56] References Cited

U.S. PATENT DOCUMENTS

| | | | |
|---|---|---|---|
| 2,483,662 | 10/1949 | Niederhiser . | |
| 2,552,694 | 5/1951 | Stoner | 279/149 |
| 2,936,010 | 5/1960 | Ansingh | 81/436 |
| 3,165,325 | 1/1965 | Goepfrich . | |
| 3,869,943 | 3/1975 | Buck . | |
| 4,095,917 | 6/1978 | Wesner | 408/221 X |
| 4,186,933 | 2/1980 | Derbyshire . | |
| 4,356,852 | 11/1982 | Smith . | |
| 4,462,728 | 7/1984 | Sturgis . | |
| 4,631,783 | 12/1986 | Hayashi | 279/149 X |
| 4,781,083 | 11/1988 | Cummings . | |
| 4,984,844 | 1/1991 | Tekeyan . | |
| 5,180,175 | 1/1993 | Doolittle . | |

OTHER PUBLICATIONS

Armstrong Bros. Tool Co. Catalog, p. 66, 1973.

*Primary Examiner*—Steven C. Bishop
*Attorney, Agent, or Firm*—Fulwider Patton Lee & Utecht

[57] ABSTRACT

A drill chuck key tool including at one end a gear and pin element for engaging a drill chuck collar and at the opposite end a socket configured for releasable receipt of a ratchet wrench drive lug for application of the mechanical advantages provided by a socket wrench to such tool.

8 Claims, 1 Drawing Sheet

DRILL CHUCK KEY TOOL

BACKGROUND OF THE INVENTION

1. Field of the Invention

The present invention relates to an improved drive chuck key.

2. Description of the Prior Art

Drill chuck keys have long been employed to provide convenient and rapid mechanical advantage for closing the jaws of a drill chuck on a cutting bit to hold the bit in place during the cutting operation. As has long been recognized by those skilled in the art, a critical shortcoming of conventional drill bit keys is that such keys typically incorporate a relatively short cross bar for acting as a finger grasp element to provide purchase for the tightening or loosening operation. Such drill chuck keys suffer the shortcoming that the cross bars are typically relatively small, inconvenient and uncomfortable to grasp by the workman's bare fingers for rotation with sufficient force to provide the necessary tightening force for positive and secure tightening of the chuck on the cutting bit to prevent slippage for misalignment during challenging cutting operations.

Oftentimes the workman prefers to tether the drill bit chuck key from an electric cord leading to an electric motor housing or to other components of the motor housing to thus prevent misplacement or loss of the key. Thus, preference has been shown for a compact key which is convenient to store during non-use and which may be easily manipulated into position during a chuck tightening or loosening procedure.

Conventional drill chuck keys thus frequently fail to positively tighten the chuck on the cutting tool thus creating, at worst, a dangerous situation for the workman while operating the drill or, at best, a potential misalignment of the cutting bit which often results in an inaccurate cutting process.

Efforts to solve the problem of inadequate leverage to achieve positive tightening or loosening of a chuck have led to the proposal that the integral key and gear segment be formed with various hand accommodating cross members. However, the cross members, to accommodate the desire for compactness in the key for storage purposes, have been typically of limited size, thus limiting the amount of mechanical advantage provided by such cross member. Chuck keys incorporating various configurations of cross bar hand grasp elements are shown in U.S. Pat. No. Derbyshire 4,186,933.

Other efforts to provide a satisfactory drill chuck key have led to the proposal of an enlarged cylindrical tool formed at one end with a gear segment having a threaded shaft projecting therefrom for threaded engagement with a custom formed threaded bore formed in the gear chuck assembly. A device of this type is shown in Sturgis U.S. Pat. No. 4,462,728. While serving the function of providing for positive engagement with the drill chuck, such devices suffer the shortcoming that the leverage afforded during the bit tightening or loosening procedure is limited by the diameter of the tool itself.

Other efforts to improve chuck keys have led to the proposal of a chuck key incorporating a lever arm having a ratchet mechanism therein with oppositely facing gear and pin elements carried from one end thereof for selective engagement with a drill chuck. A device of this type is shown in Cummings U.S. Pat. No. 4,781,083. Devices of this type suffer the shortcoming that they are relatively expensive to manufacture, are bulky and cumbersome to store and necessitate manipulation of the lever handle even prior to the time that significant forces are to be applied to the tightening action of the drill chuck.

One of the drawbacks of incorporating a crank of any substantial size in a drill chuck key is the consequent problems associated with storage of the chuck key between uses and the inconvenience that would be associated with manipulating the chuck key into position at the time of use. Thus, there exists a need for a drill chuck key which is compact and convenient to store but which will, in use, be adaptable to apply a high degree of tightening force to the drill chuck.

SUMMARY OF THE INVENTION

The drill chuck key tool of the present invention is characterized by an elongated stem formed at one end with a chuck engagement pin and gear element and at the opposite end with a multi sided socket for releasable receipt of the drive lug of a conventional socket wrench. In one embodiment, the invention also incorporates a cross bar carried by the shaft for convenient grasp by the worker to achieve initial tightening of the chuck prior to the time that the socket wrench is engaged for the final tightening procedure.

Other objects and features of the invention will become apparent from consideration of the following description taken in conjunction with the accompanying drawing.

DESCRIPTION OF THE PREFERRED EMBODIMENTS

Figure 1:
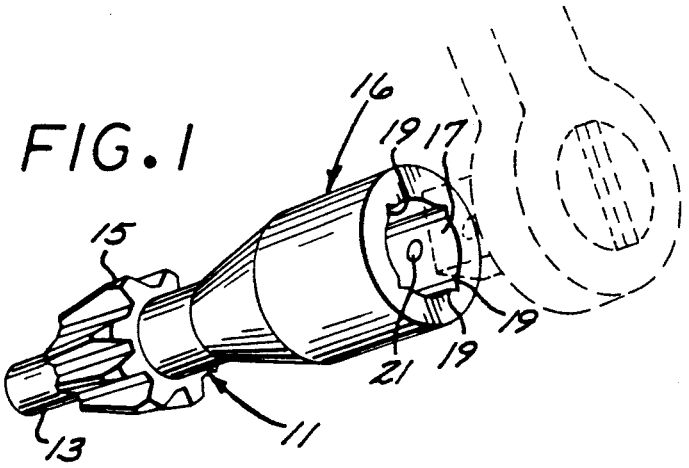
FIG. 1 is a perspective view of a chuck key embodying the present invention.

The drill chuck key of the present invention includes, generally, a stem 1 formed on one end with an axially aligned chuck pin 13 and gear segment 15. The stem is formed at the opposite end with an enlarged in diameter cross section defining a cup 16 in which is formed a lug-receiving socket 17. The socket 17 is configured for receipt of the conventional square drive lug incorporated in a conventional socket wrench such that the key may be inserted in the chuck of a drill bit or the like and rotated to tighten the chuck finger tight on the cutting bit. The drive lug of the socket wrench may then be inserted in the socket 17 and the socket wrench actuated to provide substantial mechanical advantage for further tightening of the drill chuck.

Conventional chuck keys are typically formed with a T handle with somewhat limited lateral dimensions thus severely restricting the leverage which might be applied to the key during tightening of the chuck. Consequently, in practice, the workmen frequently leave the chuck in an only partially tightened condition resulting in bit slippage when substantial forces are encountered during the cutting process. Moreover, the failure to tighten a cutting bit forcing the cutting tool into positive axial alignment, oftentimes leaves the cutting tool out of axial alignment with the chuck thus oftentimes leading to an inaccurate cut and resultant waste of the work stock. Other times, when the chuck is fully tightened during the tightening process, when it becomes time to remove the cutting tool, a conventional key does not provide sufficient leverage for convenient loosening of the chuck thus necessitating the workman resorting to tools such as pliers or wrenches to engage the chuck key for the necessary mechanical advantage of loosening the chuck.

The chuck key of the present invention in one embodiment is preferably on the order of two to three inches long and formed with a maximum diameter of three-quarters of an inch. The key is preferably of integral construction as by machining or welding during the fabrication process.

The chuck pin and gear segment 15 are of conventional construction and the cup 16 may be enlarged to an outside diameter of three-quarters of an inch and may, in practice, be welded to the stem 11. The cup 16 is formed with a polygonal socket 17 which, in the embodiment shown in FIG. 1, is generally circular in cross section but formed with triangular, axially extending grooves 19 spaced thereabout in a square pattern to be engaged by the respective four corners of a square drive lug in a conventional socket wrench. Also formed in the wall of the cup are ball detents 21 which may be engaged by the spring loaded balls of a socket wrench drive lug to releasably lock the drive lug in the socket 17.

In operation, the chuck key of the present invention may be conveniently stored in the workman's tool box or, if desired, tethered from the power cord or other convenient appendage of the work tool. When a cutting bit is to be installed in the machine chuck, the chuck is opened and the shank of the bit inserted and the chuck collar tightened to draw the collets down on the shank of the bit. The chuck pin 13 may then be inserted in one of the pin bores of the chuck and the gear segment 15 engaged with the beveled gears formed at the end of the chuck collar. The cup 16 may be grasped by the workman's fingers to further hand tighten the chuck collar on the shank of the cutting tool.

The workman may then retrieve from his tool kit a conventional socket wrench and insert the drive lug into the socket 17 to an extent engaging the spring loaded locking balls with the detents 21 to thus releasably lock the lug in place. The workman may then grasp the handle of the socket wrench and rotate the socket wrench thus applying leverage through the key to the chuck thereby applying a positive tightening force thereto for positively locking the cutting bit in place.

Once the cutting procedure has been completed and it is desirable to remove the cutting tool, the procedure described above may be essentially reversed and the ratchet mechanism in the socket wrench shifted to thus provide for the unscrewing action of the socket wrench causing the key to apply a loosening force to the chuck.

Figure 2:
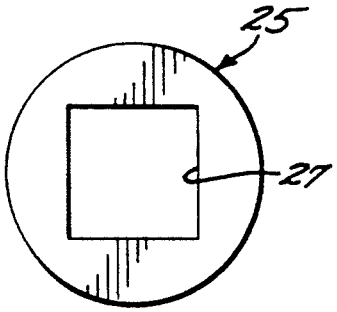
FIG. 2 is an end view of a second embodiment of the chuck key of the present invention.

Referring to the embodiment shown in FIG. 2, the cup generally designated 25 of that embodiment is formed with an interior socket 27 which is square in cross section for telescopical receipt of a socket wrench drive lug. In all other extent and operation the chuck key of FIG. 2 is of similar construction and performance.

Figure 3:
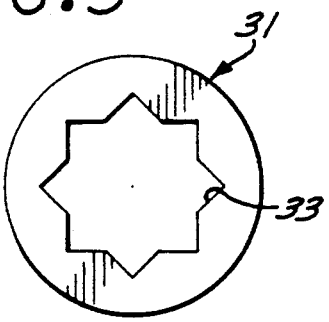
FIG. 3 is a right hand end view, in enlarged scale, of a third embodiment of the chuck key of the present invention.

Referring to FIG. 3, the cup, generally designated 31, incorporated in this embodiment is formed with a multi pointed star shaped socket 33 which provides multiple slot orientations for engagement of the socket wrench drive lug.

Figure 4:
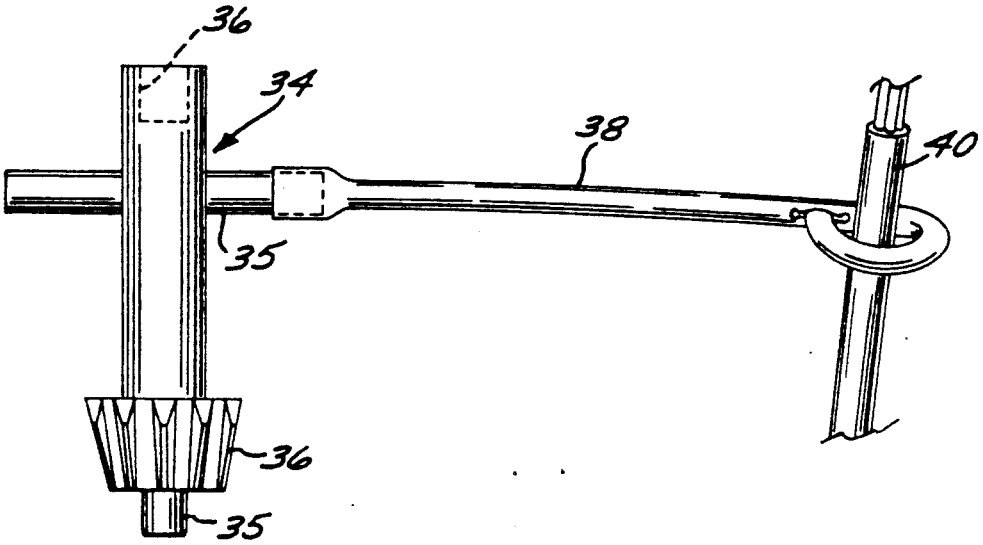
FIG. 4 is a side view of a fourth embodiment of the chuck key of the present invention.

Referring to FIG. 4, the chuck key shown therein includes a cylindrical shank, generally designated 34, formed at one end with a reduced-in-diameter chuck pin 35 and a gear segment 36. The shank 34 is formed centrally with a laterally extending bore into which is press fit a T handle 35. The free end of the shank 34 is formed with a multi sided socket 36 for telescopical receipt of a socket wrench drive lug.

Figure 5:
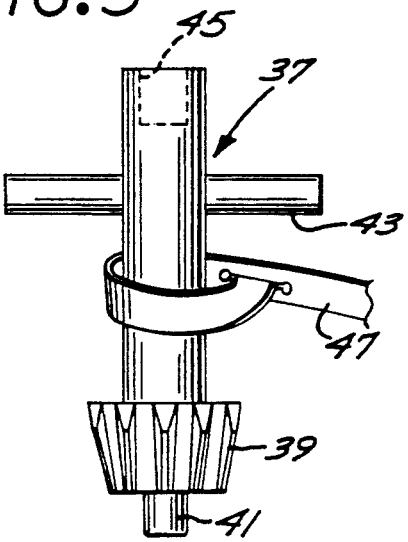
FIG. 5 is a side view of a modification of the chuck key shown in FIG. 4.

The embodiment shown in FIG. 5 incorporates a cylindrical shank, generally designated 37, which mounts at one end a gear segment 39 and chuck pin 41. Formed centrally in the shank 37 is a transverse bore into which a T handle 43 is press fit. The end of the shank 37 opposite the chuck pin 41 is then formed with a multi sided socket 45 for telescopical engagement of a socket wrench drive lug. Conveniently, a tether 47 is looped centrally about the chuck key for tethering to an electrical cord of the electrical drill.

A tether 38 is provided for friction fit of one end thereof over the handle 35 and for tethering to an electrical cord 40.

As will be appreciated by those skilled in the art, the stem may be formed with a socket having any one of a great number of different configurations for releasable engagement by a lug of a selected lever tool.

From the foregoing, it will be apparent that the chuck key of the present invention provides a compact, sturdy and practical device for conveniently tightening a drill chuck and will accommodate a mechanical advantage tool typically inventoried in the tool box used by most workmen. This device provides a practical means for facilitating tightening of a drill chuck into positive engagement with a drill bit.

Various modifications and changes may be made with regard to the foregoing detailed description without departing from the spirit of the invention.

What is claimed is:

1. A chuck key for tightening the jaws of a drill chuck of the type including a tightening collar and chuck key pin hole and being adapted for use with a socket wrench handle of the type including a drive lug of a predetermined configuration and comprising:

an elongated shank having a longitudinal central axis formed on one extremity with a chuck-engaging pin and gear teeth arrayed concentrically around said central axis at the periphery of the intermediate portion of said shank for meshing with the gear teeth of a chuck collar;

a cup formed on the extremity of said shank opposite said one extremity and including a socket arranged centrally on said central axis for releasable telescopical receipt of said lug; and said socket being formed with a polygonal transverse cross section for non-rotational engagement with said drive lug whereby said socket may be engaged over said drive lug of said socket wrench and said pin and gear portion engaged with said chuck and said socket wrench utilized as a lever to act through said tool to tighten said chuck.

2. A chuck key tool as set forth in claim 1 for use with a socket driver having spring loaded locking balls mounted therein and wherein:

said key is formed with detents to be engaged by said balls.

3. A chuck key tool as set forth in claim 1 for use with a socket wrench having a square drive lug wherein:

said cup is formed to define said socket with at least four angular grooves disposed equidistant thereabout for engagement with the respective corners of said square drive lug.

4. A chuck key tool as set forth in claim 1 wherein: said socket is square in cross section.

5. A chuck key tool as set forth in claim 1 for use with a socket wrench having a drive lug with a plurality of corners disposed equidistant thereabout wherein:

said cup is formed to define said socket and is formed in a generally circular cross section with a plurality of axial serrations disposed equidistant thereabout for engagement with the respective corners of said drive lug.

6. A chuck key tool as set forth in claim 1 that includes:

a T-handle carried from said shank.

7. A chuck key tool as set forth in claim 1 that includes:

a tether carried from said tool.

8. A chuck key tool as set forth in claim 6 that includes:

a tether carried from one end of said handle.

* * * * *